US007834552B2

(12) United States Patent
Feldtkeller et al.

(10) Patent No.: US 7,834,552 B2
(45) Date of Patent: Nov. 16, 2010

(54) CONTROLLING A LAMP BALLAST

(75) Inventors: Martin Feldtkeller, Munich (DE); Antoine Fery, Munich (DE); Michael Herfurth, Gilching (DE)

(73) Assignee: Infineon Technologies Austria AG (AT)

( * ) Notice: Subject to any disclaimer, the term of this patent is extended or adjusted under 35 U.S.C. 154(b) by 790 days.

(21) Appl. No.: 11/779,010

(22) Filed: Jul. 17, 2007

(65) Prior Publication Data

US 2009/0021174 A1 Jan. 22, 2009

(51) Int. Cl.
*H05B 37/02* (2006.01)

(52) U.S. Cl. ..... 315/94; 315/105; 315/307; 315/308

(58) Field of Classification Search ..... 315/94, 315/105, 106, 107, 98, 224, 226, 225, 291, 315/307, 308, DIG. 5, DIG. 7
See application file for complete search history.

(56) References Cited

U.S. PATENT DOCUMENTS

| | | | | |
|---|---|---|---|---|
| 6,617,805 | B2 | 9/2003 | Ribarich et al. | |
| 6,963,178 | B1 * | 11/2005 | Lev et al. | 315/307 |
| 7,002,305 | B2 * | 2/2006 | Kambara et al. | 315/291 |
| 7,378,807 | B2 | 5/2008 | Feldtkeller et al. | |

FOREIGN PATENT DOCUMENTS

| | | |
|---|---|---|
| DE | 102004037390 | 3/2006 |
| WO | 9510168 | 4/1995 |

* cited by examiner

*Primary Examiner*—David Hung Vu
(74) *Attorney, Agent, or Firm*—Banner & Witcoff, Ltd.

(57) ABSTRACT

A method and apparatus for providing electrical current to a lamp, detecting a power supply voltage outage, detecting a return of the power supply voltage, determining how long the power supply voltage outage lasted, and preheating the lamp responsive to determining that the power supply voltage outage lasted greater than a threshold amount of time.

28 Claims, 12 Drawing Sheets

CONTROLLING A LAMP BALLAST

BACKGROUND

Lamp ballasts usually include a converter having output terminals for connecting a fluorescent lamp and input terminals for applying an input voltage. The input voltage is a direct current (DC) voltage that is provided, for example, from a line voltage by a transformer stage. The converter generates from this DC voltage an AC voltage for operating the lamp, with the frequency of this alternating current (AC) voltage determining the operating state of the converter and thus of the lamp.

It is known to preheat the lamp before it is turned on for the first time or before it is turned on after a long off time, say several minutes. To this end, an AC voltage having a frequency higher than a later operating frequency of the lamp is generated by the converter. Once a specified preheat time has been reached, the lamp can then be ignited by lowering the frequency of the AC voltage to an ignition frequency. After the lamp has been ignited, the AC voltage is provided at the operating frequency. This operating frequency lies in the range of the ignition frequency.

If a fluorescent lamp turns off, for example because of an outage of the power supply, the lamp may be re-ignited immediately without a preheat phase once the power supply is restored, provided that the duration of the power outage is shorter than a maximum permissible waiting time, which is for example in the range of a second or a few seconds. Such brief outages of the power supply can occur for example in public buildings that have an emergency power supply and in which, upon an outage of a main power supply, an emergency supply is available—at least for selected circuits—within an interval of usually less than one second.

SUMMARY

Various aspects as described herein are directed to a method and apparatus for providing electrical current to a lamp, detecting a power supply voltage outage, detecting a return of the power supply voltage, determining how long the power supply voltage outage lasted, and preheating the lamp responsive to determining that the power supply voltage outage lasted greater than a threshold amount of time.

These and other aspects of the disclosure will be apparent upon consideration of the following detailed description of illustrative aspects.

BRIEF DESCRIPTION OF THE DRAWINGS

A more complete understanding of the present disclosure may be acquired by referring to the following description in consideration of the accompanying drawings, in which like reference numbers indicate like features, and wherein.

DETAILED DESCRIPTION

The various aspects summarized previously may be embodied in various forms. The following description shows by way of illustration various examples in which the aspects may be practiced. It is understood that other examples may be utilized, and that structural and functional modifications may be made, without departing from the scope of the present disclosure.

Except where explicitly stated otherwise, all references herein to two or more elements being "coupled," "connected," and "interconnected" to each other is intended to broadly include both (a) the elements being directly connected to each other, or otherwise in direct communication with each other, without any intervening elements, as well as (b) the elements being indirectly connected to each other, or otherwise in indirect communication with each other, with one or more intervening elements.

Illustrative embodiments as described herein relate to a method for driving a lamp ballast, and the lamp ballast itself. The lamp ballast may include, for example output terminals for connecting a lamp thereto, and input terminals for receiving a power supply voltage and that is adapted for taking on at least one of a state of low power consumption and a lamp operating state. The method may provide, for example, for monitoring at least one operating parameter of the lamp ballast and converting the lamp ballast to the state of low power consumption if the operating parameter indicates an outage of the power supply voltage. After the lamp ballast has been converted to the state of low power consumption, the operating parameter is monitored cyclically and the lamp ballast is directly converted to the lamp operating state if the operating parameter indicates that a power supply voltage is present again and if an interval since the beginning of the state of low power consumption is less than a specified standby time.

Figure 1:
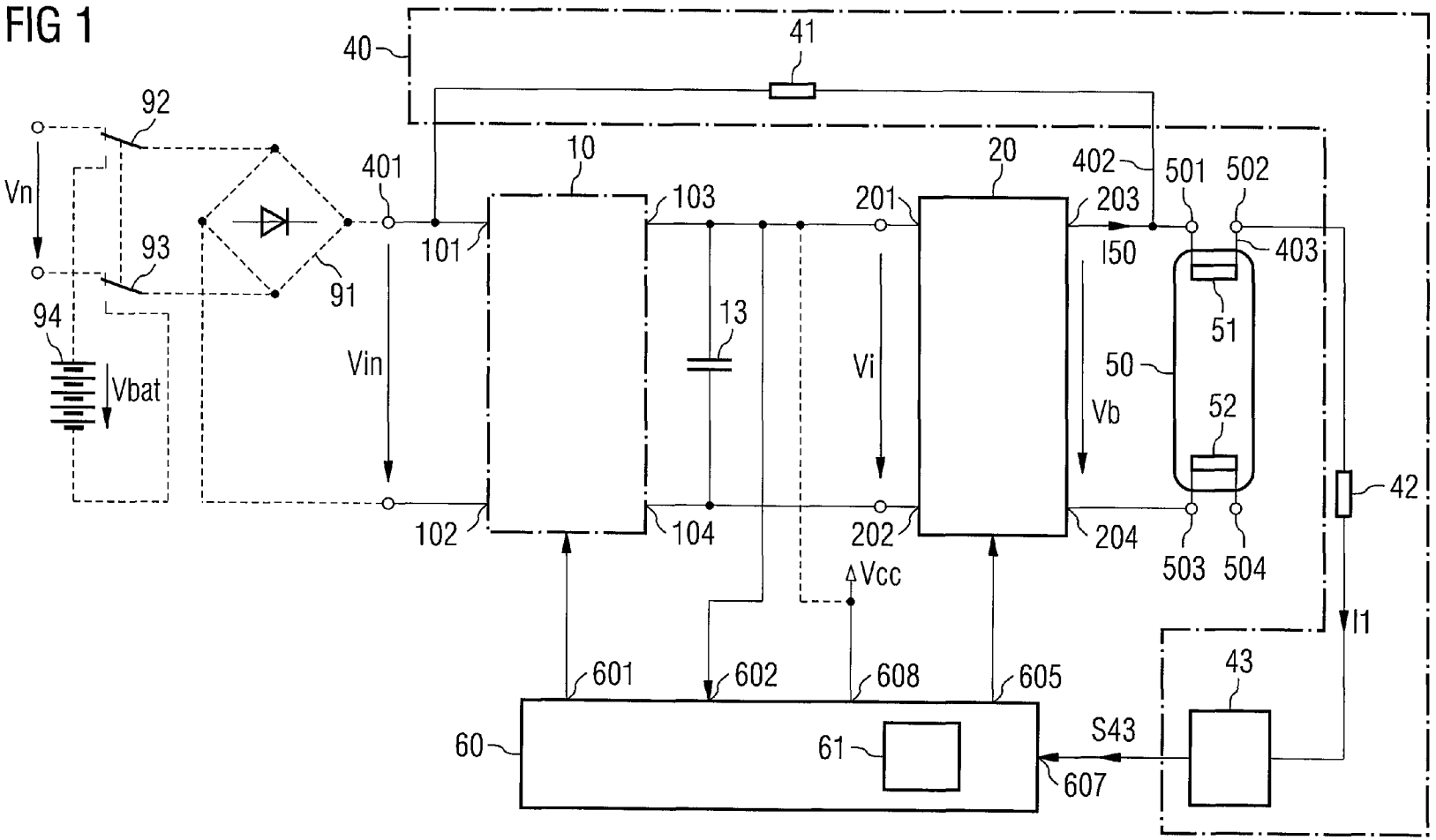
FIG. 1 is a functional block diagram of an illustrative lamp ballast.

A drive circuit for a lamp ballast according to an illustrative embodiment is illustrated in FIG. 1. In the example illustrated, this drive circuit includes an evaluation and drive circuit 60 and a detector circuit 40 connected to evaluation and drive circuit 60. For better understanding of the mode of functioning of this drive circuit, FIG. 1 illustrates further components of the lamp ballast, which will be explained next.

The lamp ballast as shown includes a converter 20 having input terminals 201, 202 for applying an input voltage Vi and having output terminals 203, 204 for connecting a fluorescent lamp 50 and for providing a power supply voltage Vb for the fluorescent lamp 50. For better understanding, such a fluorescent lamp 50 is likewise illustrated in FIG. 1. In the illustrative embodiment shown, fluorescent lamp 50 includes two lamp coils 51, 52, each having two terminals 501, 502 and 503, 504 respectively. A first terminal 501 of a first lamp coil 51 is connected to a first output terminal 201 of the inverter, and a first terminal 501 of a second lamp coil 52 is connected to a second output terminal 204 of converter 20.

In order to provide the input voltage Vi of converter 20, there is a transformer stage 10, which exhibits input terminals 101, 102 for applying a power supply voltage Vin and output terminals 103, 104 for providing the input voltage Vi of converter 20. In what follows, this input voltage Vi of converter 20 is also referred to as intermediate circuit voltage. Transformer stage 10 may include, for example, a boost converter that is adapted to generate from the power supply voltage Vin an intermediate circuit voltage Vi that is larger in absolute value than the power supply voltage Vin.

The power supply voltage Vin is available, for example, at the output of a bridge rectifier 91, to which a line voltage Vn or a battery voltage Vbat is supplied as input voltage, with the input voltage being selected by changeover switches 92, 93. In the case of a sinusoidal line voltage Vn as the input voltage of bridge rectifier 91, the power supply voltage Vin of the lamp ballast is a voltage having the form of the absolute value of a sine wave. In the case of a battery voltage Vbat as the input voltage of bridge rectifier 91, the power supply voltage Vin is a DC voltage. For the explanation that follows, suppose that a line voltage Vn as the input voltage of bridge rectifier 91 represents a normal operating case, while a battery voltage Vbat represents an emergency operating case in which, after an outage of the line voltage Vn, a battery 94 takes over the further supply. A battery-backed emergency power supply may be present, for example, in public buildings and may serve to ensure an emergency power supply in case of an outage of a main power supply. The emergency power supply may take effect within an extremely short time after an outage of the main power supply, for example within an interval shorter than one second.

Transformer stage 10 is adapted to generate the intermediate circuit voltage Vi with a specified amplitude both from a power supply voltage Vin having the form of the absolute values of a sine wave and also from a DC voltage as the power supply voltage Vin. Transformer stage 10 is here controlled via evaluation and control circuit 60, which is supplied with a signal dependent on the intermediate circuit voltage Vi via an input 604 and is adapted to control transformer stage 10 in such fashion that the intermediate circuit voltage Vi is controlled to a specified set point, for example 400 V, approximately independently of the current draw of converter 20 and approximately independently of the input voltage Vin.

Evaluation and control circuit 60 is furthermore adapted to control converter 20 in such fashion that the converter provides a suitable power supply voltage Vb in dependence on the desired operating state of lamp 50. There may be essentially four operating states for the operation of fluorescent lamp 50 and thus for converter 20 and the lamp ballast:

1. An off state, in which the power supply voltage Vb is lower than a lamp operating voltage. Lamp 50 is off in this case.
2. A lamp operating state, in which the power supply voltage Vb is an AC voltage having an operating frequency suitable for lamp 50, for example between 40 kHz and 60 kHz. The lamp is on (burns) during this operating state.
3. A preheat phase, in which the power supply voltage Vb is an AC voltage having a preheat frequency, for example between 80 kHz and 100 kHz, that is higher than the operating frequency. During this operating state the lamp is not yet on (burning).
4. An ignition phase, in which a frequency of the power supply voltage Vb is lowered from the preheat frequency to an ignition frequency. The ignition frequency here is in the range of the operating frequency of fluorescent lamp 50 or higher, for example between 45 kHz and 70 kHz. If the lamp ignites and if the ignition frequency is higher than the operating frequency, the frequency may subsequently be lowered to the operating frequency.

Evaluation and control circuit 60 is adapted to set one of these operating states of converter 20 and, therefore, of the lamp ballast. When lamp 50 is turned on for the first time or when lamp 50 is turned on again after a prolonged waiting time, for example a waiting time of several seconds, the preheat phase may take place first for a specified preheat time. After the preheat time has elapsed, the ignition phase follows, and after successful ignition of the lamp comes the lamp operating phase. For the explanation that follows, it is assumed by way of example that the drive circuit may likewise take on at least four operating states that correspond to the lamp operating states. For instance, in an off state, the drive circuit controls converter 20 in such fashion that the lamp is turned off, in a preheat state so that the lamp is preheated, in an ignition state so that the lamp is ignited, and in an operating state so that the lamp burns. Depending on the particular embodiment, the drive circuit may take on further operating states, which will be explained by way of example.

If a burning fluorescent lamp is turned off, the fluorescent lamp may be turned on again directly within a brief time window without a preheat phase. The time window may be, e.g., up to a few seconds. This time window, within which the fluorescent lamp may be directly re-ignited without a preheat phase, is referred to as the standby time in the following. Such brief intervals may play a role particularly in the power supply systems previously explained, in which a switchover to an emergency power supply takes place within a short time after an outage of the main power supply. In buildings having such power supply systems, it may be desired that fluorescent lamps that were burning before the outage of the power supply are turned on again as promptly as possible, without a preheat phase, once the emergency power supply takes effect, provided the emergency power supply is available within the standby time.

In the following, a power supply outage (also referred to as an outage of the power supply) means a drop in the power supply voltage Vin to zero or to another voltage value at which a sufficient supply to the lamp ballast is no longer provided. In order to detect such an outage of the power supply to the lamp ballast, drive circuit 40, 60 is adapted to monitor an operating parameter of the lamp ballast and to convert converter 20 at least to a state of low power consumption, for example the off state, if the monitored operating parameter indicates an outage of the power supply. The monitored operating parameter may be, for example, the intermediate circuit voltage Vi. In the case of an outage of the power supply, the intermediate circuit voltage Vi decreases. Evaluation and control circuit 60 compares this intermediate circuit voltage Vi with a first threshold value and converts converter 20 to the state of low power consumption if the intermediate circuit voltage Vi falls below this threshold value. For the explanation that follows, it is assumed by way of example that the operating parameter can indicate two distinct supply states of the lamp ballast: a first supply state in which the power supply is out and a second supply state in which the power supply is in order.

Because of an output capacitor 13 of transformer stage 10, which may serve to smooth the intermediate circuit voltage Vi, the intermediate circuit voltage Vi decreases only very slowly after converter 20 is turned off, in comparison to a state with converter 20 turned on. A power supply of drive circuit 40, 60 can still be provided for some time after an outage of the power supply via the energy stored in output capacitor 13 of transformer stage 10. Once converter 20 is turned off (that is, once converter 20 is converted to the off state), the power consumption of drive and evaluation circuit 60 may be already declining. A further reduction in the power consumption of evaluation and drive circuit 60 may be achieved by also turning off transformer stage 10 or otherwise converting it to a state of low power consumption upon the detection of an outage of the power supply. Upon the detection of an outage of the power supply, the drive circuit thus may also enter a state of low power consumption, which will be generically referred to herein as the off state, in accordance with the lamp operating state. The drive circuit is not, however, entirely turned off during this state but still possesses a power consumption covered via capacitor 13 of the transformer stage, which is required in order to maintain the basic functions of the drive circuit.

One of these basic functions may be to detect the restoration of the power supply and suitably drive converter 20 and transformer stage 10 after such a detection. As used herein, power supply restoration (also referred to as restoration of the power supply) means the rise in the power supply voltage Vin to a voltage value sufficient to supply the lamp ballast or to a voltage value sufficient to provide the intermediate circuit voltage Vi. Detector circuit 40 serves to detect such a restoration of the power supply, this detector circuit having a first terminal 401 connected to one 101 of the input terminals of transformer stage 10 and providing a detector signal S43, which is supplied to evaluation and drive circuit 60. This detector signal S43 is dependent on a power supply voltage Vin present between input terminals 101, 102 of transformer stage 10 and is further dependent on the presence of a lamp 50 connected to output terminals 203, 204 of converter 20. For generating the detector signal S43, detector circuit 40 in the example illustrated includes a resistance network 41, 42 and an evaluation circuit 43 connected to resistance network 41, 42. The resistance network includes for example a first resistance 41, which is connected between first input terminal 101 of transformer stage 10 and first output terminal 203 of converter 20. If a lamp 50 is in place, first terminal 501 of first lamp coil 51 is connected to this first output terminal 203 of converter 20. The resistance network further includes a second resistance 42, which is connected between second terminal 502 of first lamp coil 51 and evaluation circuit 43 when a lamp is in place. Evaluation circuit 43 is adapted to evaluate a current I1 flowing through this resistance network 41, 42. A current I1 greater than zero flows through resistance network 41, 42 only when a lamp 50 is in place, that is, when the break present between first and second resistances 41, 42 in resistance network 41, 42 is bridged by lamp coil 51 of lamp 50, and when the power supply voltage Vin is greater than zero. Detector circuit 40 thus may have two functions: It may serve firstly to detect the presence of the lamp, and it may serve secondly to detect a power supply voltage Vin greater than zero. A zero power supply voltage Vin and an absent lamp 50 have the same effect on the current I1 evaluated by evaluation circuit 43. The detector signal S43 may nevertheless be utilized to detect a restoration of the power supply after an outage of the power supply, as is explained in the following:

Evaluation and control circuit 60 is adapted to control transformer stage 10 in order to provide the intermediate circuit voltage Vi, and to control converter 20 to ignite the lamp only when the detector signal S43 indicates that a power supply voltage Vin is present and a lamp 50 is in place. If, after an outage of the power supply voltage Vin, the lamp is turned off in the manner that has been explained, the lamp may be directly turned on again without a prior preheat phase if the power supply voltage is again available within a short time of maximally several seconds. This time is so short that it is unlikely that a lamp replacement has taken place during this time. It may therefore be inferred that in the case of a previously burning lamp, the same already burning lamp is present and may be ignited without a preheat phase if the power supply is restored within the standby time after an outage of the power supply and thus after converter 20 has been turned off.

If lamp 50 is removed during operation, so that detector signal S43 indicates that no lamp 50 is in place, transformer stage 50 and converter 20 are likewise turned off via evaluation and control circuit 60. Upon an outage of the power supply, detector signal S43 takes on the same value as if lamp 50 were removed. A differentiation of cases between an outage of the power supply and a removal of lamp 50 during operation is possible because when lamp 50 is removed during operation, the intermediate circuit voltage Vi does not decrease immediately but only when transformer stage 10 is turned off by evaluation and control circuit 60. In case of an outage of the power supply, the intermediate circuit voltage Vi decreases even before evaluation and control circuit 60 turns off transformer stage 10.

Evaluation and control circuit 60 as illustrated is adapted to control converter 20 for direct ignition of lamp 50 without a preheat phase if, after an outage of the power supply, which may be detected for example through the intermediate circuit voltage Vi, the detector signal S43 indicates a restoration of the power supply within the standby time. The drive circuit then goes directly from the off state to the ignition state and, after successful ignition of the lamp, into the lamp operating state. In order to measure the interval between the outage of the power supply and the restoration of the power supply, evaluation and drive circuit 60 exhibits for example a clock generator 61, which is schematically illustrated in FIG. 1. After an outage of the power supply and the transition of evaluation and control circuit 60 into the state of low power consumption, this clock generator 61 continues to be supplied with energy, for example directly or indirectly from output capacitor 13 of transformer stage 10. Even after an outage of the power supply voltage Vin, a basic function of drive circuit 60, 40 for turning the lamp on again is thus provided at least for the standby time.

Instead of by evaluating the intermediate circuit voltage Vi, an outage of the power supply may also be detected by evaluating a current I50 in lamp 50, which is available at the output of converter 20. If this current I50 falls below a specified current threshold for a specified interval that is longer than one period of the lamp voltage Vb, an outage of the power supply Vi is inferred. At least converter 20 and optionally also transformer stage 10 and evaluation and control circuit 60 are then converted to the state of low power consumption.

Figure 2:
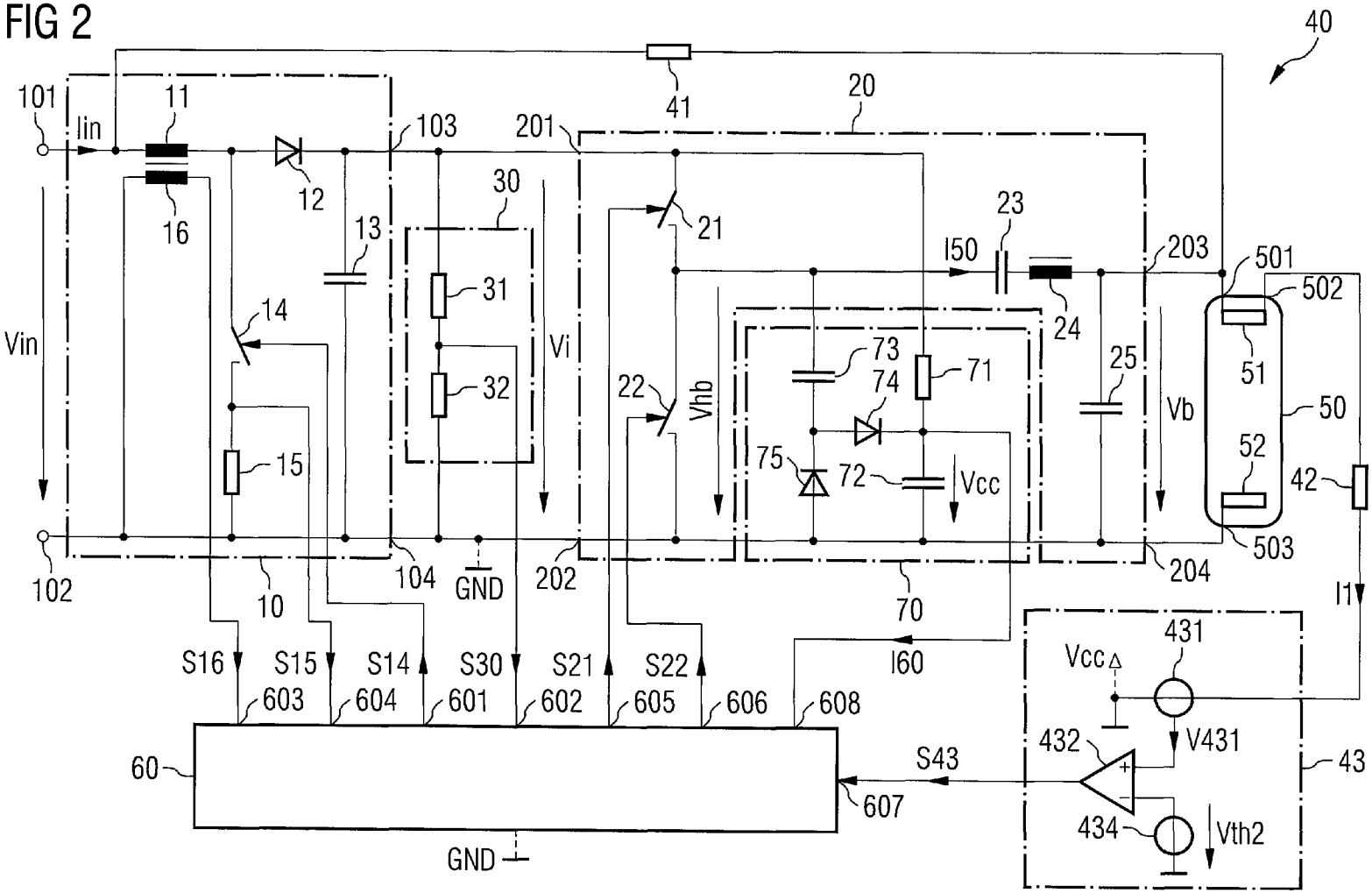
FIG. 2 is an illustrative schematic circuit diagram of various individual functional blocks of the lamp ballast illustrated in FIG. 1.

For further explanation, FIG. 2 depicts illustrative implementations of transformer stage 10, converter 20 and evaluation circuit 43 of detector circuit 40. In the example illustrated, converter 20 includes a half-bridge circuit having a first switch 21 and a second switch 22, which are connected in series between input terminals 201, 202 of converter 20. At one output of the half-bridge, which is formed by one of the common circuit nodes common to both switches 21, 22, a series oscillatory circuit having an oscillatory circuit capacitance 25 and an oscillatory circuit inductance 24 is connected. A circuit node common to oscillatory circuit capacitance 25 and oscillatory circuit inductance 24 here forms the first output terminal 203 of converter 20 for the connection of lamp 50. If a lamp is present, the lamp is connected in parallel with oscillatory circuit capacitance 25 in this arrangement. Between the output terminal of half-bridge 21, 22 and the series oscillatory circuit, the lamp ballast illustrated has a further capacitance 23, which essentially serves to filter out a DC component of the output voltage Vhb of the half-bridge. A capacitance value of further capacitance 23 here is much greater than the capacitance value of oscillatory circuit capacitance C25, so that this further capacitance has no substantial effect on the resonant frequency of the oscillatory circuit 24, 25.

Both switches 21, 22 of the half-bridge are driven via first and second drive signals S21, S22 of evaluation and control circuit 60, which are available at outputs 605, 606 of evaluation and control circuit 60. Switches 21, 22 are driven alternately, so that a rectangular or trapezoidal AC voltage, whose frequency corresponds to the drive frequency of switches 21, 22, is available at the output of the half-bridge. The lamp voltage Vb when the lamp is ignited then corresponds to an approximately sinusoidal AC voltage having this frequency. The individual operating states of converter 20, already explained, are set via control and evaluation circuit 60 through the frequency of the pulse-width-modulated drive signals S21, S22 of half-bridge 21, 22.

In the example illustrated, transformer stage 10 is a boost converter and includes a series circuit of an inductive storage element 11 and a switch 14 between input terminals 101, 102. Connected in parallel with switch 14 is a series circuit having a rectifier element 12 and output capacitor 13. Connecting terminals of capacitor 13 here form output terminals 103, 103 of transformer stage 10, at which the intermediate circuit voltage Vi is available. Switch 14 of transformer stage 10 is driven in pulse-width-modulated fashion via a third drive signal S14, which is available at one output 601 of evaluation and control circuit 60. When switch 14 is closed, inductive storage element 11 absorbs energy via input terminals 101, 102; when switch 14 is subsequently opened, it delivers this energy via rectifier element 12 to output capacitor 13 and to converter 20, which is connected downstream to the transformer stage 10.

The pulse duty-cycle of the pulse-width-modulated third drive signal S14, set by evaluation and drive circuit 60, determines the intermediate circuit voltage Vi in a basically known manner. In order to control the intermediate circuit voltage Vi to a nominal Value, evaluation and control circuit 60 is supplied via a first measurement input 602 with an intermediate circuit voltage signal S30, which is dependent on the intermediate circuit voltage Vi. This intermediate circuit voltage signal S30 is provided, for example, by a voltage divider 30, which includes voltage divider resistances 31, 32 and is connected between output terminals 103, 104 of transformer stage 10. The duty-cycle of the third drive signal S14 may be set in dependence on this intermediate circuit voltage signal S30 with the objective of controlling the intermediate circuit voltage Vi to the specified nominal value, for example 400 V.

Transformer stage 10 may in particular be a power factor controller (PFC), having a power factor correction capability. In some embodiments, in the case of such a power factor controller, the current draw is controlled in such a way that an average of an input current Iin is proportional to the applied input voltage Vin. This may be achieved for example by turning the switch on cyclically for an on time dependent on the intermediate circuit voltage Vi, with switch 14 being re-closed after switch 14 is opened as soon as, or otherwise after, inductive storage element 11 is partially or completely demagnetized. The control of the power consumption of transformer stage 10 for controlling the intermediate circuit voltage Vi is effected through the on time. In order to detect the times of demagnetization, evaluation and control circuit 60 is supplied, via a second input 603, with a magnetization signal S16, which corresponds to the voltage across an auxiliary coil 16 that is inductively coupled with inductive storage element 11 and includes a terminal facing away from evaluation and control circuit 60 and connected to second input terminal 102 of transformer stage 10. This second terminal 102 of transformer stage 10 is at a common reference potential GND, for example ground, with second output 104 of transformer stage 10, second input 202 and second output 204 of converter 20.

Optionally, transformer stage 10 includes a current measuring resistance 15 connected in series with switch 14, at which a current measurement signal S15 can be picked up, which current measurement signal is supplied to evaluation and control circuit 60 via a third measurement input 604. This current measuring resistance 15 may be present for safety reasons in order to detect an overcurrent when switch 14 is closed and thus to be able to turn off switch 14.

In the lamp ballast illustrated, there is a power supply circuit 70 for the power supply to drive circuit 60, 40. This power supply circuit 70 in the example includes a starting resistance 71, which is connected between output capacitor 13 of transformer stage 10 and a power supply input 608 of control and evaluation circuit 60. When a power supply voltage Vin is applied, a charging current flows through inductive storage element 11 and rectifier element 12 of transformer stage 10 as well as starting resistance 71 to a power supply capacitor 72 in series circuit with starting resistance 71, a power supply voltage Vcc being available for the drive circuit across the power supply capacitor. This current begins to flow as soon as a power supply voltage Vin is applied and does not necessarily require any drive of transformer stage 10. This power supply voltage provided via starting resistance 71 makes it possible to turn on evaluation and control circuit 60 and thus to drive transformer stage 10 as well as converter 20. On grounds of power loss, starting resistance 71 may be chosen such that the current flowing through starting resistance 71 is not sufficient to provide a supply to evaluation and control circuit 60 continuously, in particular not when evaluation and control circuit 60 is generating pulse-width-modulated control signals to drive transformer stage 10 and converter 20. Power supply circuit 70 may therefore additionally include a charge pump 73, 74, 75, which is connected between the output of half-bridge 21, 22 and power supply capacitor 72. In the case of a half-bridge 21, 22 driven in clocked fashion, power supply capacitor 72 is supplied from the intermediate circuit voltage Vi principally via this charging pump 73-75 and first switch 21 of the half-bridge.

In the example illustrated, evaluation circuit 43 of detector circuit 46 includes a current measurement arrangement 431 for acquiring a current I1 flowing through second resistance 42. Here, a terminal of second resistance 42 facing away from second terminal 502 of first lamp coil is connected to a terminal for a reference potential. This reference potential may correspond to the supply potential Vcc of evaluation and control circuit 60, which lies for example in the range between 5 V and 20 V, or may correspond to the common reference potential GND of the circuit components of the lamp ballast.

Current measurement arrangement 431 provides a current measurement signal V431, which is compared with a reference voltage Vth2 provided by a reference voltage source 434 by a comparison element 432, for example a comparator. Available at the output of comparison element 432 is the detector signal S43, which in the example illustrated takes on a high level when the current measurement signal V431 is higher than the reference voltage and takes on a low level when the current measurement signal V431 is lower than the reference voltage Vth2. Accordingly, S43=1 denotes a high level while S43=0 denotes a low level of the detector signal S43.

Evaluation and control circuit 60 is adapted to detect an outage of the power supply, for example on the basis of the intermediate circuit voltage Vi, monitor the detector signal S43 after an outage of the power supply and, via first and second control signals S21, S22, convert converter 20 directly to the ignition state without a preheat phase, and to the lamp operating state after the lamp has ignited, if the detector signal S43 indicates a restoration of the power supply within the standby time. A restoration of the power supply may be inferred, for example, if the detector signal S43 changes from a low level to a high level within the standby time. Evaluation and control circuit 60 and evaluation circuit 43 of detector circuit 40 are illustrated as separate circuit blocks for reasons of explanation. It should be pointed out, however, that evaluation and control circuit 60 and evaluation circuit 43 of detector circuit 40 may be jointly implemented such as in an integrated circuit arrangement. Resistances 41, 42 of detector circuit 40 in this case are implemented for example as external components of the integrated circuit.

In the following, the mode of functioning of the drive circuit previously explained with evaluation and control circuit 60 as well as detector circuit 40 is explained on the basis of waveforms of the power supply voltage Vin, the intermediate circuit voltage Vi, a current draw 160 of evaluation and control circuit 60, the output voltage Vhb of half-bridge 21, 22 of converter 20, the drive signal S14 of transformer stage 10, and the current measurement signal V431 of detector circuit 40. The waveform of the current measurement signal corresponds to the waveform of the current through resistance network 41, 42. For purposes of explanation, it is assumed by way of example that up to a time t0 the lamp ballast is in a lamp operating state, as a state in which a lamp 50 is in place and in which lamp 50 is burning. For clarity, FIG. 3 does not show the actual waveform of the input voltage Vin and rather shows whether a power supply voltage Vin is present, which is the case up to the time t0 in the example illustrated. The solid line stands for a power supply voltage Vin resulting from the line voltage Vn in the example illustrated, while the dot-dash line stands for an input voltage Vin resulting from the battery voltage Vbat.

Figure 3:
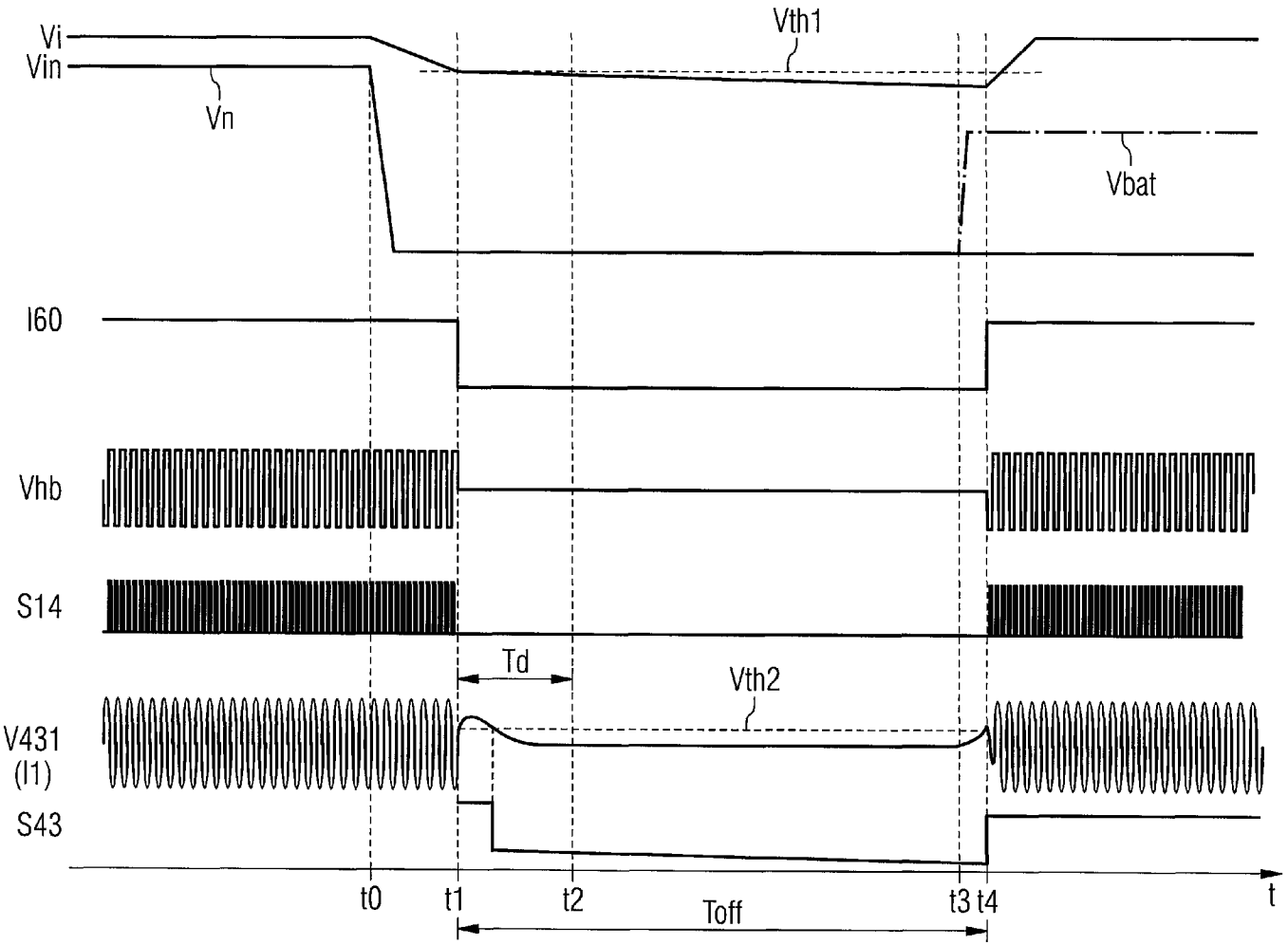
FIG. 3 is a series of graphs representing various illustrative waveforms of signals that may occur in a lamp ballast.

When lamp 50 is on, half-bridge 21, 22 of converter 20 supplies a rectangular or trapezoidal AC voltage Vhb at a lamp operating frequency. In this operating state, transformer stage 10 is likewise in operation, which in FIG. 3 is made clear by the pulse-width-modulated drive signal S14 of switch 14 of transformer stage 10. The intermediate circuit voltage Vi is thus at a nominal value higher than a first threshold value Vth1. The current I1 through resistance 42 of resistance network 41, 42 possesses a sinusoidal waveform corresponding to the power supply voltage Vb of the lamp when lamp 50 is burning.

In the example illustrated in FIG. 3, an outage of the power supply is in effect from the time t0 on; the input voltage Vin begins to decline toward zero starting at this time. Transformer stage 10 and converter 20 initially continue to be driven, so that lamp 50 continues to burn. The energy used for this is taken from output capacitor 13 of transformer stage 10, so that the intermediate circuit voltage Vi decreases. When at a time t1 the intermediate circuit voltage Vi decreases to the first threshold value Vth1, the evaluation and control circuit turns converter 20 and transformer stage 10 off, for example by driving switches 14, 21 and 22 in blocking fashion. The output voltage Vhb of half-bridge 21, 22 then takes on a not exactly defined voltage value. In the waveform illustrated in FIG. 3 and for purposes of further explanation, it is assumed that this output voltage Vhb, after the decay of the energy stored in series oscillatory circuit 24, 25, settles to a voltage value that corresponds to roughly half the intermediate circuit voltage Vi. After time t1 the intermediate circuit voltage Vi decreases further, but much more slowly than before this time t1. The further decrease of the intermediate circuit voltage Vi after deactivation of transformer stage 10 is principally due to a further current draw 160 of the drive circuit, but can also additionally result from parasitic effects. The current draw of the drive circuit is much reduced just because transformer stage 10 and converter 20 are deactivated, so that evaluation and control circuit 60 is not providing pulse-width-modulated drive signals for transformer stage 10 and converter 20. In a manner not set forth in greater detail, circuit components inside evaluation and control circuit 60 can also be deactivated after transformer stage 10 and converter 20 have been deactivated, in order in this way to reduce further the current draw 160 of the evaluation and control circuit. A reduced current draw of the evaluation and control circuit after time t1 is illustrated in FIG. 3 by an abrupt drop in the input current 160 at time t1.

Evaluation and control circuit 60 is adapted to monitor the detector signal S43 after time t1, that is, after an outage of the power supply has been detected, in order to detect a restoration of the power supply on the basis of the signal level of this detector signal S43. Transient effects, however, may result in the current I1 through the resistance network not yet being zero immediately after the outage of the power supply voltage Vin, but only decreasing slowly. The current measurement signal V431 may therefore continue to lie above the reference value Vth2 during a short interval after the outage of the power supply voltage Vin. In an illustrative embodiment, that evaluation and control circuit 60 therefore monitors the detector signal S43, looking for a restoration of the power supply voltage, only after the lapse of a delay time Td once an outage of the power supply voltage has been detected. A time starting at which such monitoring of the detector signal S43 is in effect is denoted as t2 in FIG. 3.

For further explanation, suppose that at a later time t3 the power supply is restored, for example by activation of a battery-backed emergency power supply. A current I1 through the resistance network begins to rise at this time, the rise in current being limited by parasitic effects such as for example charging of capacitor 25, which is in parallel circuit with lamp 50. At a time t4 the current measurement signal V431 reaches the current reference value Vth2, so that the detector signal S43 takes on a high level. Evaluation and control circuit 60 detects this level change in the detector signal S43 and then activates transformer stage 10 and converter 20. When transformer stage 10 is activated, the intermediate circuit voltage Vi begins to increase again toward the set point. The operating state in which converter 20 is placed by evaluation and control circuit 60 will now depend on the interval, referred to as the off time Toff in the following, between a detection of an outage of the power supply Vin at time t1 and a detection of a restoration of the power supply Vin at time t4. If this off time Toff is shorter than the standby time Tstby, converter 20 is converted directly to the ignition state and subsequently to the lamp operating state; half-bridge 21, 22 is thus driven at the ignition frequency and subsequently the operating frequency of the lamp in order to ignite the lamp directly without waiting through a new preheat phase. If the off time Toff is longer than the standby time, the cycle executed is the same as in a cold start of the lamp; that is, evaluation and control circuit 60 converts converter 20 first to a preheat phase and subsequently, after an ignition phase, to the operating phase.

Figure 4:
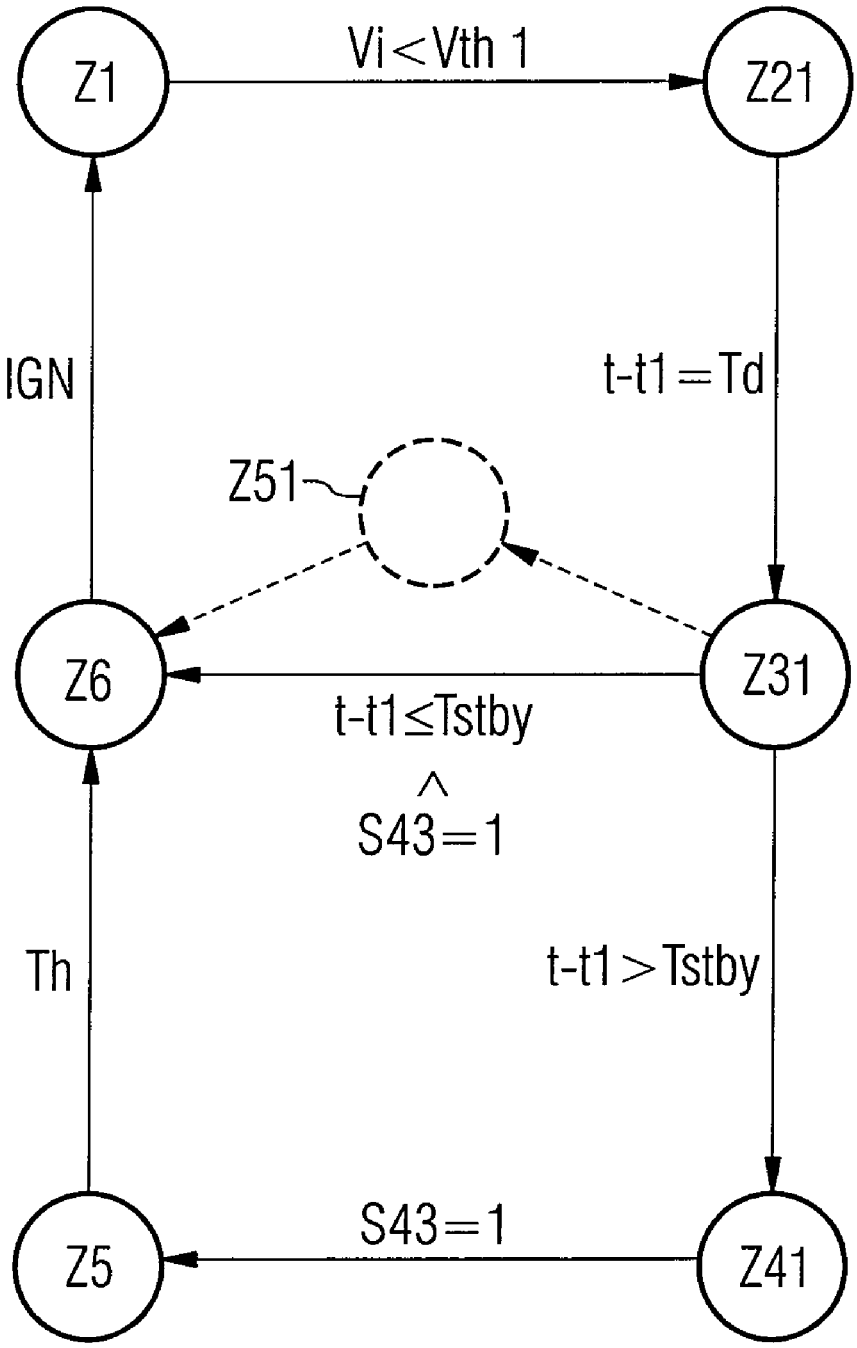
FIG. 4 is an illustrative state diagram of various states of a drive circuit, consistent with the waveforms of FIG. 3.

For further elucidation of the method explained, FIG. 4 depicts an illustrative state diagram in which individual operating states of the drive circuit and criteria for a state transition between the respective operating states are illustrated. For the explanation that follows, suppose that operating states of the drive circuit correspond to the respective operating states of the lamp ballast. The operating state of the drive circuit thus determines the operating state of the entire ballast. If for example the drive circuit is in the lamp operating state, then the lamp ballast is also in the lamp operating state. The individual operating states may differ, for example, in the frequency at which the half-bridge of converter 20 is driven or in the activation or deactivation of transformer stage 10.

In FIG. 4 Z1 denotes a lamp operating state in which the drive circuit drives transformer stage 10 to provide the intermediate circuit voltage Vi and drives converter 20 to provide a lamp voltage Vb at a lamp operating frequency. Z21 denotes a first wait state, into which the drive circuit goes upon the detection of an outage of the power supply, for example when the intermediate circuit voltage Vi falls below the first threshold value Vth1. In the example illustrated in FIG. 3, the drive circuit takes on this first wait state at time t1. During this first wait state Z21, the drive circuit deactivates transformer stage 10 and converter 20. There is not, however, any monitoring of the detector signal S41 with a view to a restoration of the power supply, or a level of the detector signal is ignored during this interval. After the delay time Td has elapsed, the drive circuit goes into a second wait state Z31, in which transformer stage 10 and converter 20 still remain deactivated but the detector signal S43 is monitored with a view to a restoration of the power supply. If during this second wait state Z31 a restoration of the power supply voltage Vin is detected on the basis of the detector signal S43, for example (see FIG. 3) because the detector signal S43 takes on a high level, and if the off time Toff since the detection of the outage of the power supply is shorter than the standby time Tstby, then the drive circuit goes directly into an ignition state Z6 and from the ignition state, after the lamp has ignited, into the lamp operating state Z1 again. During the ignition state Z6, transformer stage 10 is activated to provide the intermediate circuit voltage Vi and converter 20 is activated in such fashion that it provides an AC voltage at an ignition frequency. The drive circuit may possess functionality for detecting ignition of the lamp, so that the drive circuit does not change over to the lamp operating state Z1 until after the lamp has ignited. Such functionality is basically known for lamp ballasts, so that no further discussion of it is necessary.

If the off time Toff since the detection of the outage of the power supply voltage exceeds the standby time Tstby, the drive circuit goes into a third wait state Z41, in which transformer stage 10 and the converter are deactivated and the detector signal S43 is still monitored. If during this third wait state Z41 a restoration of the power supply is detected on the basis of the detector signal S43, a turn-on cycle including lamp preheating and ignition is executed. Here the drive circuit goes first into a preheat state Z6, in which transformer stage is activated and converter 20 is activated in order to preheat lamp 50. After a preheat time Th has elapsed, the drive circuit goes into the ignition state Z6 and into the lamp operating state Z 1 after the lamp has ignited. An initial state of the drive circuit after a starting process, that is, after the power supply voltage Vcc is provided, is for example the third wait state Z41. This starting process is always executed if the power supply voltage Vcc of the drive circuit has fallen to zero, after the ballast has been turned off, or to voltage values not sufficient to supply the drive circuit.

The drive circuit may change from the second wait state Z31 to a shortened preheat state Z51 (indicated by dashed lines) after a restoration of the power supply has been detected, and into the ignition state after a shortened first preheat time has elapsed. The first preheat time here is shorter than the "normal" preheat time Th executed during the turn-on cycle with a cold lamp. This normal preheat time is also referred to as second preheat time in the following. The first preheat time of the shortened preheat state Z51 may be much shorter than the second preheat time and much shorter than the standby time. For example, the first preheat time is between 1% and 10% of the standby time, while the second preheat time Th can be in the range of this standby time or longer. In the following, the phrase "direct transition of the drive circuit into the lamp operating state," and similar phrases, means a transition without a preheat state or a transition after a shortened preheat state.

Figure 5:
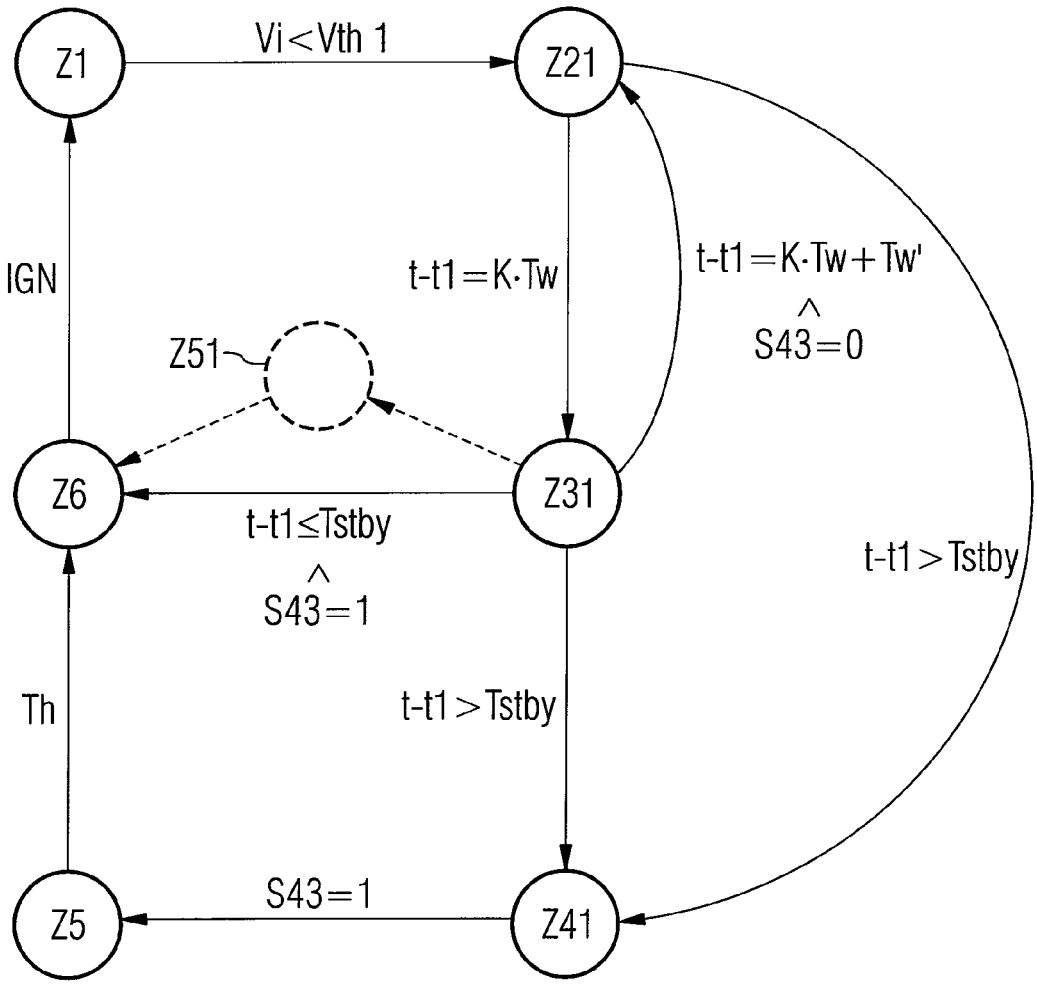
FIG. 5 is an illustrative variation of the state diagram of FIG. 4.

FIG. 5 depicts an illustrative modification of the method previously explained. In this method, the drive circuit goes into the first wait state Z21 when an outage of the power supply voltage is detected and goes from this first wait state into the second wait state Z31 at regular time intervals, each time for a monitoring time Tw' during which the detector signal S43 is monitored with a view to a restoration of the power supply voltage Vin. Starting from time t1, there is a transition from the first wait state Z22 into the monitoring state Z32, for example every time $t-T1=k\cdot Tw$, where k is a positive whole number and Tw denotes the duration of a period. The monitoring time Tw' is smaller in each case than the period Tw. The period Tw here is longer than or equal to the wait time Td that elapses while waiting out transient processes after the power outage has been detected (see FIG. 3). If, during the second wait state Z31 during the monitoring time, a restoration of the power supply is detected and the off time Toff is shorter than the standby time, the drive circuit makes a direct transition to the ignition state Z6; in other words, the lamp is immediately ignited without a prior preheat phase. If the standby time Tstby elapses during the first or the second wait state Z21, Z31, the drive circuit goes into the third wait state Z41. If a restoration of the power supply voltage is detected during the third wait state Z42, the cold-start cycle with preheat phase Z5 and ignition phase Z6 is executed.

Figure 6:
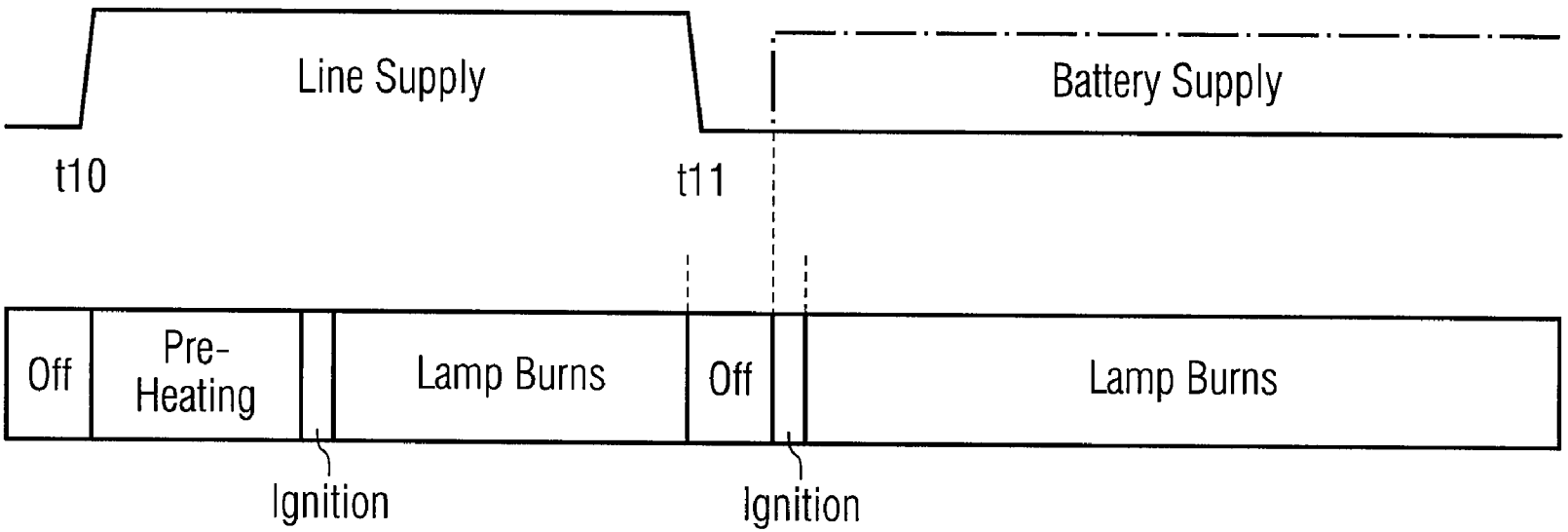
FIG. 6 is a chart showing illustrative basic operations of a lamp ballast in the case of a brief power supply outage.

A basic cycle for a cold start of the lamp and a restoration of the lamp after an outage of the power supply voltage is illustrated in FIG. 6. Suppose that up to a time t10 there is no power supply. The lamp is thus off until this time. If the power supply takes effect at a time t10, a preheat phase begins, in which control and evaluation circuit 60 drives the converter at a preheat frequency. After a preheat time has elapsed, an ignition phase follows, in which the frequency of converter 20 is reduced to an ignition frequency. The lamp burns after successful execution of the ignition cycle. If the power supply goes out at a time t11, the lamp may be immediately re-ignited without a preheat phase if the power supply is restored within an interval shorter than the standby time. In this case the ignition phase is executed directly, that is, without a preheat phase.

In the following, a drive circuit for a lamp ballast and a method for driving a lamp ballast, without providing a detector signal that is dependent on a power supply voltage Vin and a lamp 50 in place, is explained with reference to FIGS. 7 and 8. The basic structure of the lamp ballast illustrated in FIG. 7 corresponds to that of the lamp ballast illustrated in FIG. 2, with the difference that the drive circuit exhibits no detector circuit for providing a detector signal S43 dependent on the power supply voltage Vin and the presence of a lamp.

Figure 7:
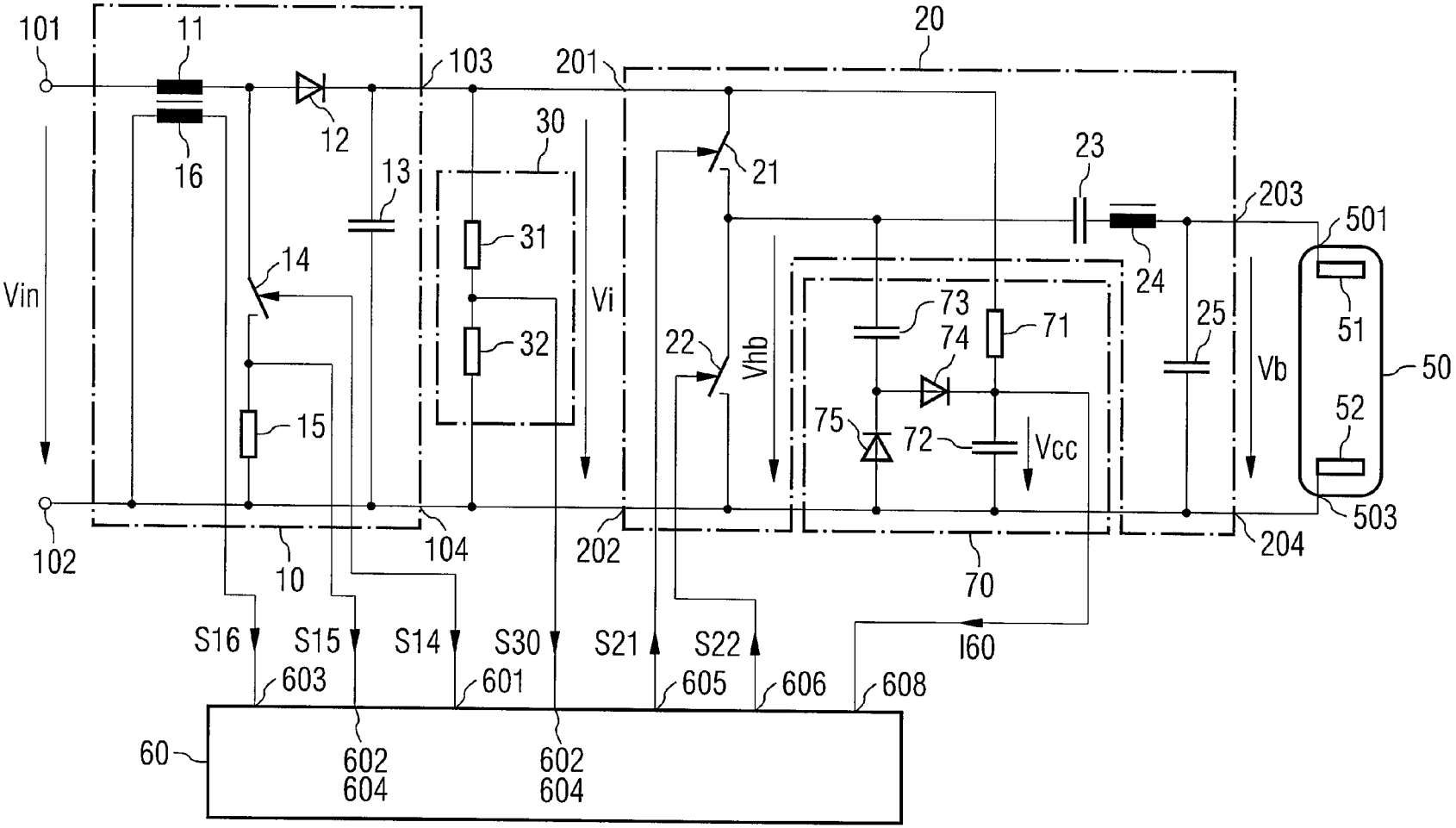
FIG. 7 is a schematic circuit diagram of another illustrative lamp ballast.
Figure 8:
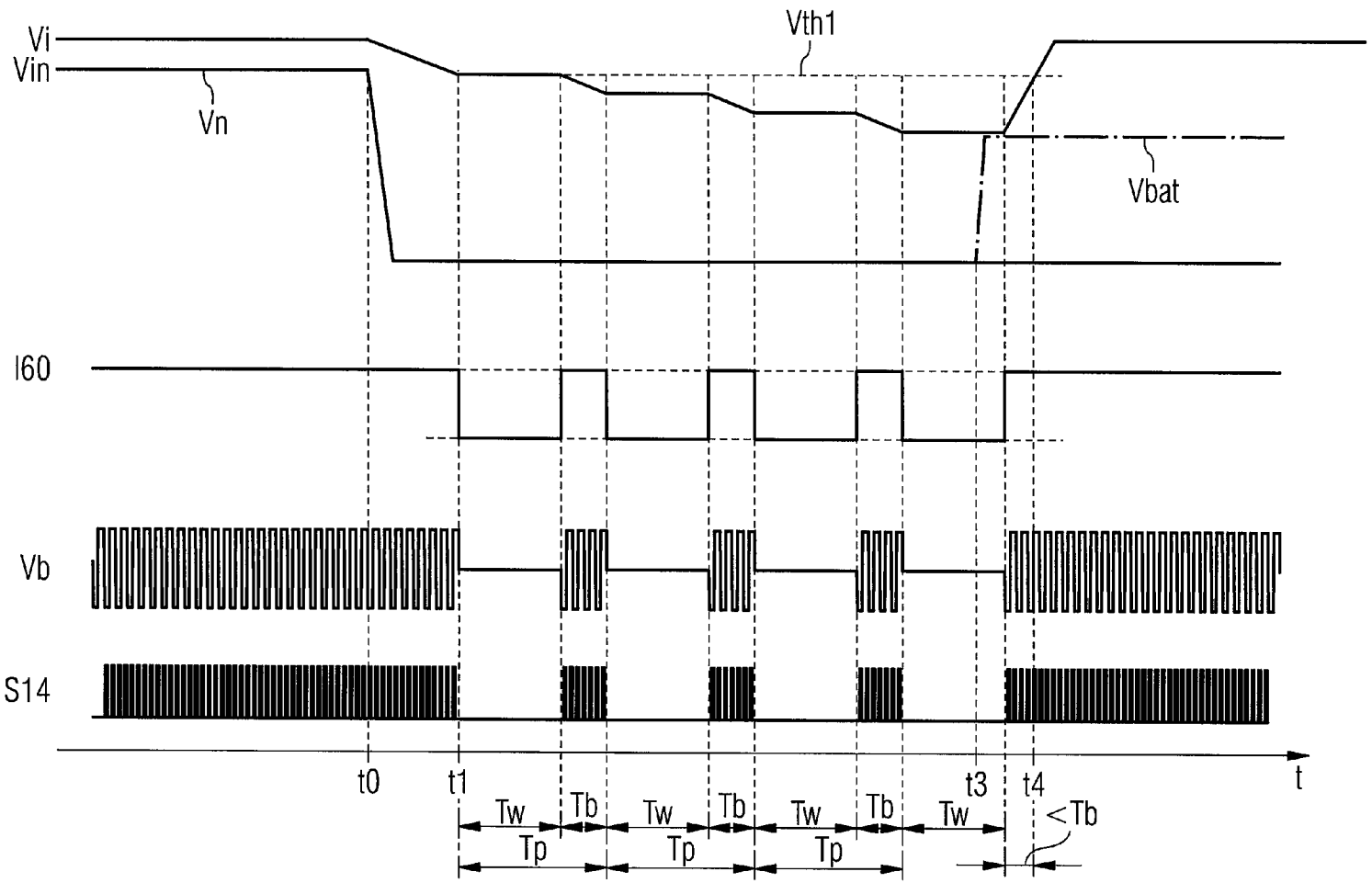
FIG. 8 is a series of graphs representing various illustrative signal waveforms, wherein after an outage of a power supply, an operating parameter of the lamp ballast is cyclically monitored on the basis of signal waveforms.

The mode of functioning of an illustrative embodiment of drive circuit 60 illustrated in FIG. 7 will be visualized in terms of waveforms of the input voltage Vin, the intermediate circuit voltage Vi, a current draw 160 of drive circuit 60, an output voltage Vhb of half-bridge 21, 22, and the drive signal S14 of switch 14 of transformer stage 10, which are illustrated in FIG. 8. Drive circuit 60 is adapted to monitor an operating parameter of the lamp ballast in order to detect an outage of the power supply. For the explanation that follows, suppose that this operating parameter is the intermediate circuit voltage Vi. Instead of the intermediate circuit voltage, however, an output current I50 of converter 20 may also be evaluated.

With reference to FIG. 8, suppose that the lamp ballast is initially in a lamp operating state, in which the lamp is burning, and that a power supply is present up to a time t0. Transformer stage 10 and converter 20 are activated by drive circuit 60, converter 20 being activated in such fashion that it provides a lamp voltage Vb at a lamp operating frequency. If the power supply goes out at time t0, transformer stage 10 and converter 20 initially remain activated until the intermediate circuit voltage Vi has decreased to the first threshold value Vth1, as is the case at time t1 in FIG. 8. At this time, drive circuit 60 detects an outage of the power supply and deactivates transformer stage 10 and converter 20 in such a way that these go into a state of low power consumption. As soon as transformer stage 10 and converter 20 are deactivated, drive circuit 60 also goes into a state of low power consumption, it being possible to deactivate further circuit components of drive circuit 60 that are not needed at the present time, in a manner not set forth in more detail, in order to reduce the power consumption of drive circuit 60 further.

Drive circuit 60 is adapted to activate transformer stage 10 cyclically, each time for a specified interval Tb, after the power outage is detected, and to evaluate the behavior of the monitored operating parameter, the intermediate circuit voltage Vi in the example. If the intermediate circuit voltage Vi during such an evaluation time Tb exceeds the first threshold value Vth1, a restoration of the power supply is inferred, as illustrated at a time t3 in FIG. 8. If the time interval Toff between the detection of the power outage and the detection of a restoration of the power supply voltage at time t4 is shorter than the standby time, drive circuit 60 effects ignition of lamp 50 immediately, via converter 20, without a prior preheat phase.

It may be desirable to activate not only transformer stage 10 but also converter 20 during the evaluation times Tb, but at a frequency that can lie above the operating frequency and the ignition frequency of the lamp and can also lie above the preheat frequency of the lamp. The activation of converter 20 in this case is exclusively for the purpose of supplying power to drive circuit 60 via the charging pump 73-75 of power supply circuit 70. By activating transformer stage 10, the power consumption of drive circuit 60 can increase so much that its power demand cannot be covered solely via starting resistance 71. With reference to FIG. 8, the higher power consumption of drive circuit 60 during the evaluation phases Tb, but above all the activation of converter 20, leads to a decrease in the intermediate circuit voltage Vi during these evaluation phases Tb that is faster than during wait times Tw between the monitoring or activation times Tb. In FIG. 8, Tp denotes a period length after which transformer stage 10 is activated for an activation time Tb each time.

Figure 9:
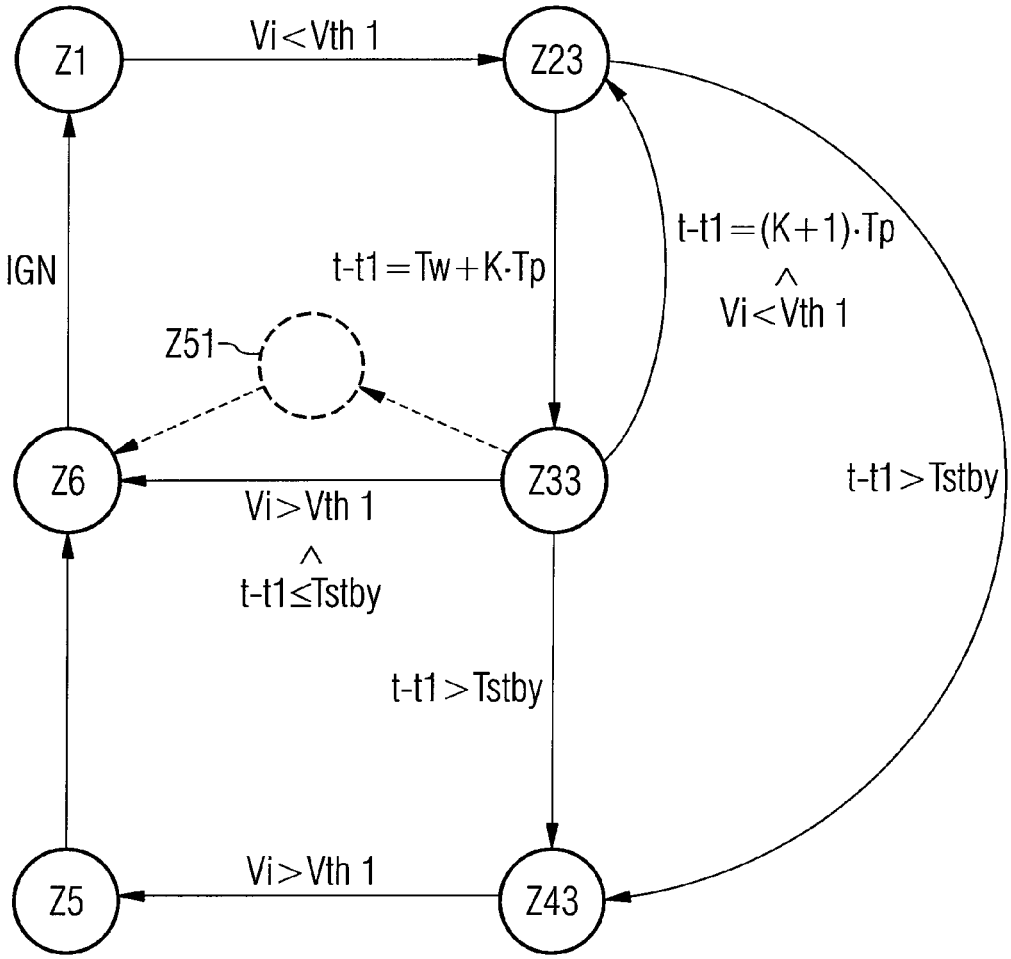
FIG. 9 is an illustrative state diagram consistent with the waveforms of FIG. 8.

FIG. 9 elucidates the method explained with reference to FIG. 8, using a state diagram. Here Z1 denotes a lamp operating state, in which transformer stage 10 and converter are activated and in which lamp 50 burns. The drive circuit goes into a first wait state Z23 if an outage of the power supply is detected, for example on the basis of the intermediate circuit voltage Vi. From this first wait state Z23, the drive circuit cyclically goes into an activation or monitoring state Z33, in which at least transformer stage 10 is activated for the specified activation time Tb. In FIG. 9, the expression t−t1=Tw+k·Tp, where k is a whole number greater than or equal to zero, denotes cyclically recurring times at which the drive circuit goes into the activation state Z33. If a restoration of the power supply is detected during this activation state Z33, for example because the intermediate circuit voltage Vi exceeds the first threshold value Vth1, and if a wait time since the detection of the power outage is shorter than the standby time Tstby, then the drive circuit goes directly into the ignition phase Z6 without a prior preheat phase, and from the ignition phase Z6 into the lamp operating phase Z1. The drive circuit may change to the ignition state Z6 after a shortened preheat state Z51, in accordance with the example explained with reference to FIG. 4.

If no restoration of the power supply is detected during the activation state Z33, that is, the intermediate circuit voltage Vi remains below the first threshold value Vth1, then the drive circuit returns to the first wait state Z23 after the lapse of the activation time Tb. From both the wait state Z23 and the activation state Z33, the drive circuit makes a transition to a second wait state Z43 if the wait time is longer than the standby time Tstby.

At the beginning of the second wait state Z43, converter 20 and transformer stage 10 are for example continuously activated. Because of the resulting power consumption, the intermediate circuit voltage Vi may continue to decrease until the supply to drive circuit 60 via power supply circuit 70 is no longer provided and drive circuit 60 deactivates itself on account of insufficient power supply voltage. If a power supply voltage Vin is again available after a deactivation of the drive circuit, intermediate circuit capacitor 13 of transformer stage 10 is charged, through inductance 11 and rectifier element 12, to the peak value of the applied power supply voltage Vin, without transformer stage 10 being activated at first. The voltage value that comes into effect on intermediate circuit capacitor 13 is commonly lower than the intermediate circuit voltage that takes effect when transformer stage 10 is activated. At the same time, a current flows through starting resistance 71 to power supply capacitor 72. The value of starting resistance 71 is chosen here such that restarting of drive circuit 60 is possible with the lower intermediate circuit voltage Vi and the resulting supply to drive circuit 60. If the power supply to drive circuit 60 is restored during the third wait state Z43, the drive circuit activates transformer stage 10. In this way, the intermediate circuit voltage Vi rises again. If the intermediate voltage Vi exceeds the first threshold value Vth1, the drive circuit goes into preheat state Z5, into the ignition state Z6 after the preheat time has elapsed, and into the lamp operating state after the ignition IGN of the lamp. Depending on whether the intermediate circuit voltage Vi decreases so much during the third wait state that the supply to the drive circuit is interrupted, further operating states can come about during the third wait state, in the manner previously explained.

In order to save electrical energy, which may be supplied exclusively by output capacitor 13 of transformer stage 10 when the power supply is interrupted, provision may be made in some embodiments to break off the activation state Z33 prematurely, before the activation time Tb has elapsed, if on the basis of a further evaluation criterion it is determined that no increase in the intermediate circuit voltage Vi can be expected within the activation time Tb. In some embodiments, the magnetization signal S16 provided by transformer stage 10 is evaluated. This magnetization signal S16 is illustrated by way of example in FIG. 10 during an activation phase of transformer stage 10, in which the power supply is not yet present, and during an activation phase after the power supply is again present. If there is no power supply voltage, the magnetization signal S13 does not exceed a third threshold value Vth3. Drive circuit 60 is adapted to monitor the magnetization signal S16 during an activation time and to terminate the activation time prematurely if the magnetization signal S16 does not exceed the third threshold value Vth3 within a shortened activation time Tb'. In the example illustrated, the magnetization signal S16 exceeds the third threshold value Vth3 during an activation phase. The activation phase is then not terminated prematurely, but a check is performed throughout the activation time to determine whether the intermediate circuit voltage Vi exceeds the first threshold value Vth1.

Figure 10:
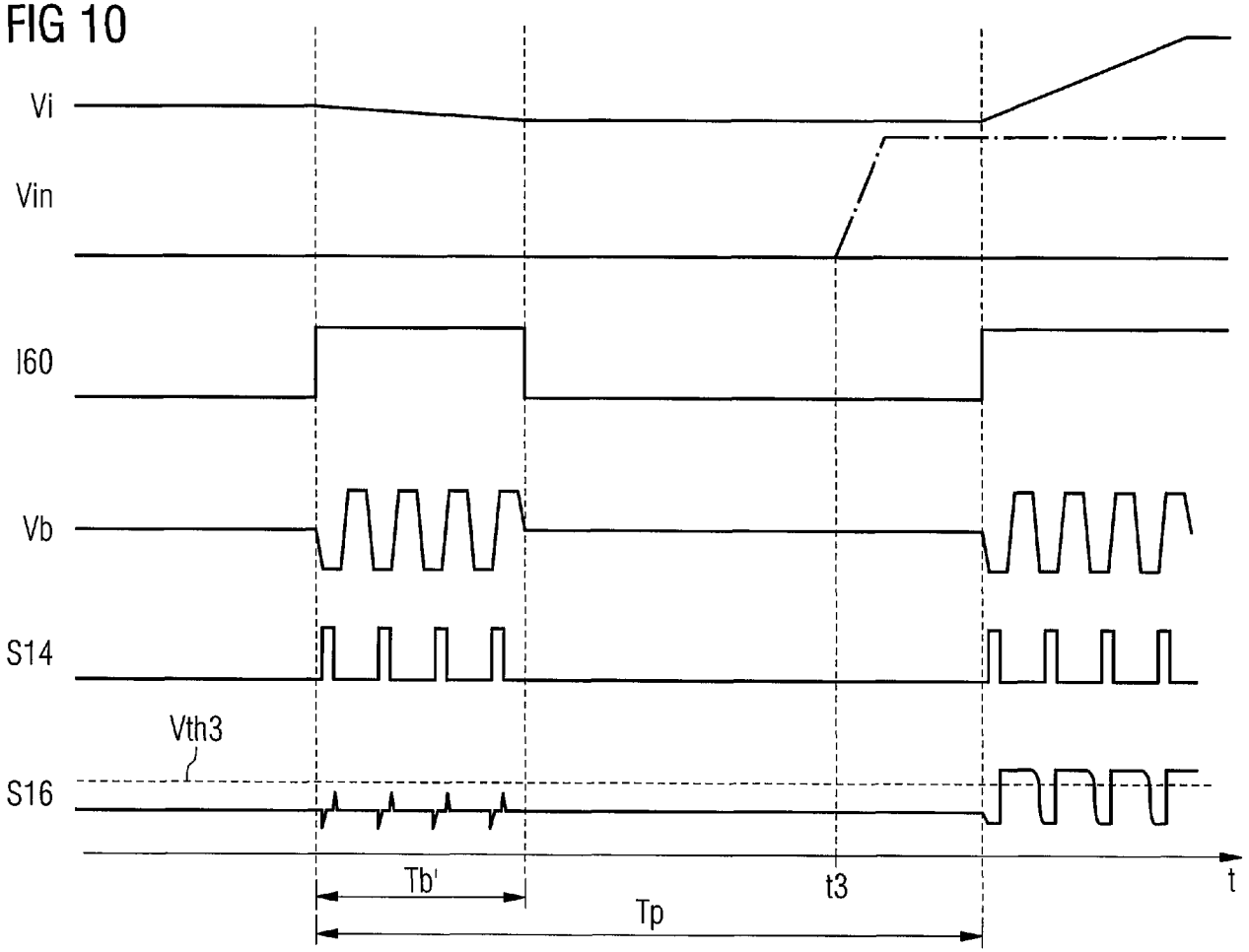
FIG. 10 is another series of graphs of various illustrative signal waveforms, wherein after a power outage, an operating parameter of the lamp ballast is cyclically monitored on the basis of signal waveforms.
Figure 11:
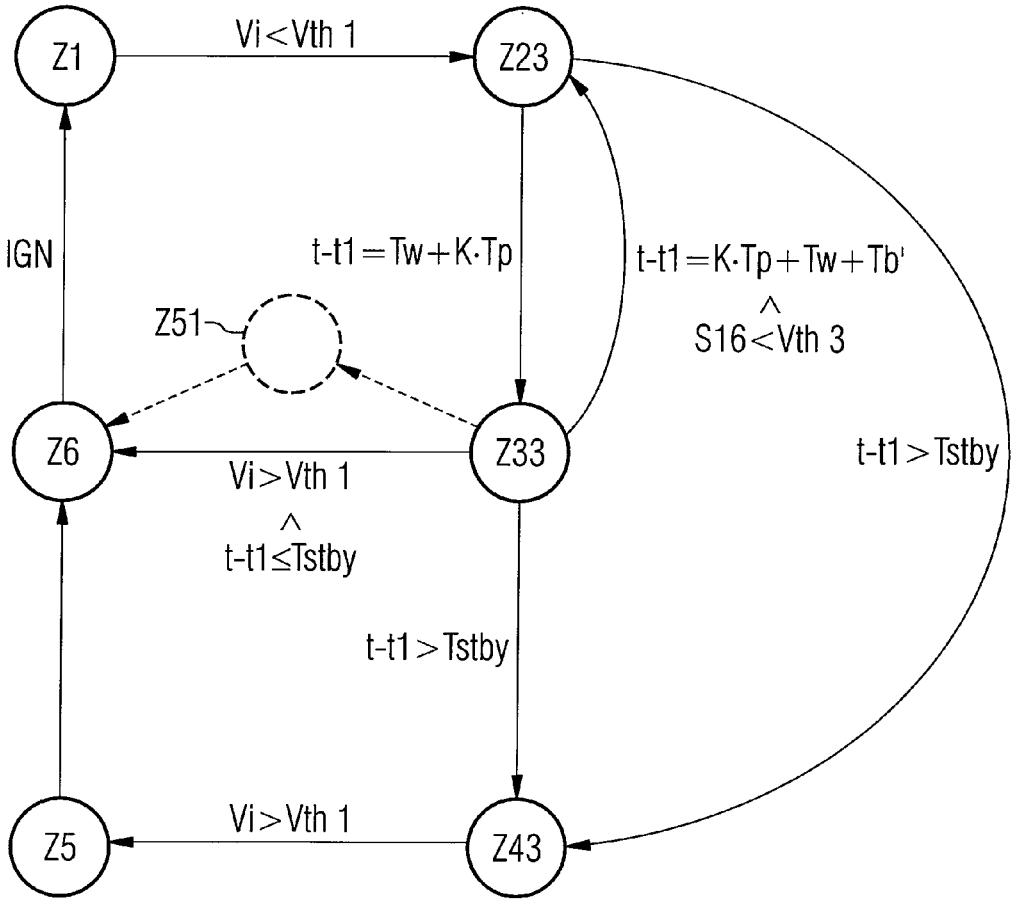
FIG. 11 is an illustrative state diagram consistent with the waveforms of FIG. 10.

FIG. 11 depicts an illustrative state diagram relating to the method previously explained with reference to FIG. 10. This state diagram differs from the one illustrated in FIG. 9 in that a transition from the activation state Z33 to the wait state Z23 takes place prematurely if the magnetization signal does not exceed the third threshold value Vth3 before a shortened activation time Tb' has elapsed. A transition into the wait state Z23 furthermore takes place if, in the case of a non-shortened activation time, the intermediate circuit voltage Vi does not exceed the first threshold value Vth1 during the maximum allowable activation time.

Figure 12:
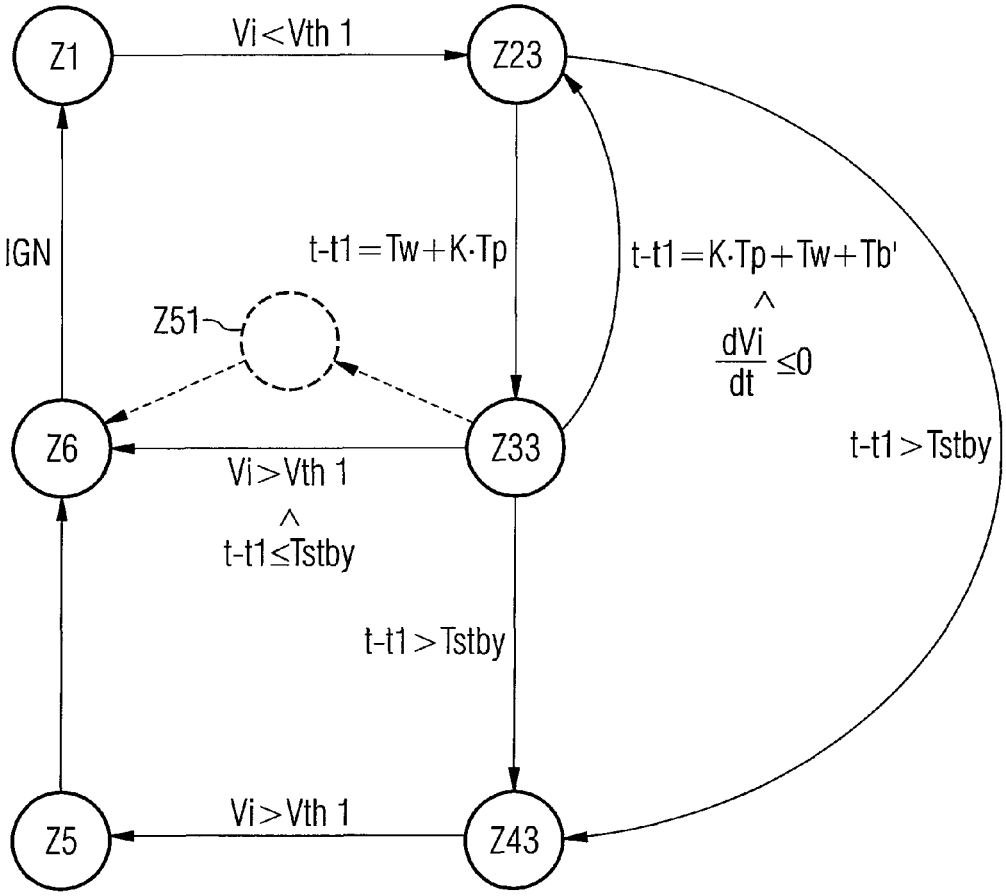
FIG. 12 is an illustrative variation of the state diagram of FIG. 11.

In a further illustrative modification of the method explained previously, a change in the intermediate circuit voltage Vi during the activation time may be additionally examined and the activation time is terminated prematurely when, for example, the intermediate circuit voltage remains constant or even decreases. FIG. 12 depicts an illustrative state diagram for this method. In this method, a transition from the activation state Z33 to the first wait state Z23 takes place prematurely if a constant or decreasing intermediate circuit voltage Vi is detected during the activation time.

In some embodiments, transformer stage 10 and the converter are left activated after a detection of an outage of the power supply, but converter 20 is converted to an operating state in which the frequency of its output voltage Vb is higher than the operating frequency, so that the lamp does not burn, and converting the lamp again to ignition without a preheat phase if a restoration of the power supply is detected within the standby time.

The invention claimed is:

1. A method, comprising:

providing electrical current to a lamp;

detecting a power supply voltage outage;

detecting a return of the power supply voltage;

determining how long the power supply voltage outage lasted; and first preheating the lamp for a first period of time responsive to determining that the power supply voltage outage lasted greater than a threshold amount of time.

2. The method of claim 1, further comprising providing further electrical current to the lamp without preheating the lamp responsive to determining that the power supply voltage outage lasted less than the threshold amount of time.

3. The method of claim 1, further comprising, prior to detecting the power supply voltage outage, second preheating the lamp for a second period of time, wherein the first period of time is less than the second period of time.

4. A method, comprising:

generating a detector signal that depends on a power supply voltage and a presence of a lamp;

monitoring an operating parameter of a lamp ballast coupled to the lamp;

causing the lamp ballast to enter a low power consumption state responsive to the operating parameter indicating an outage of the power supply voltage;

monitoring the detector signal during the low power consumption state; and if, during the low power consumption state, the detector signal indicates that the power supply voltage is present and the lamp is present, and if an interval between a beginning of the low power consumption state and the detection of the power supply voltage is shorter than a predetermined standby time, causing the lamp ballast to change from the low power consumption state to a lamp operating state without entering a preheat state, or to the preheat state for a first preheat time and then to the lamp operating state.

5. The method of claim 4, further comprising causing the lamp ballast to change from the low power consumption state to the preheat state for a second preheat time that is longer than the first preheat time before entering the lamp operating state, responsive to the detector signal indicating during the low power consumption state that the power supply voltage is present and the lamp is present, and if an interval between a beginning of the low power consumption state and the detection of the power supply voltage is longer than the standby time.

6. The method of claim 5, wherein the second preheat time is at least 60% of the standby time.

7. The method of claim 4, wherein the first preheat time is shorter than the standby time.

8. The method of claim 7, wherein the first preheat time is 20% or less of the standby time.

9. The method of claim 4, wherein the operating parameter is a current in the lamp.

10. The method of claim 4, wherein the standby time is between 0.3 second and 2 seconds.

11. The method of claim 4, wherein monitoring the detector signal comprises monitoring the detector signal responsive to a specified wait time having elapsed since a beginning of the low power consumption state.

12. The method of claim 11, wherein monitoring the detector signal comprises cyclically monitoring the detector signal after the wait time has elapsed.

13. An apparatus, comprising:

means for monitoring an operating parameter of the lamp ballast and conversion of the lamp ballast to a low power consumption state responsive to the operating parameter decreasing below a specified limiting value;

means for monitoring a detector signal during the low power consumption state; and means for causing the lamp ballast to change from the low power consumption state to a lamp operating state without entering a preheat state, or to the preheat state for a first preheat time and then to the lamp operating state, if the detector signal indicates during the low power consumption state that a power supply voltage is present and a lamp connected to the lamp ballast, and if an interval between a beginning of the low power consumption state and the detection of the power supply voltage is shorter than a predetermined time interval.

14. A method, comprising:

monitoring an operating parameter of a lamp ballast, and causing the lamp ballast to enter a low power consumption state responsive to the operating parameter indicating an outage of a power supply voltage; and cyclically monitoring the operating parameter for a monitoring time, and causing the lamp ballast to enter a lamp operating state from the low power consumption state without a preheat state or after a preheat state having a first preheat time, responsive to the operating parameter indicating that the power supply voltage is present and if an interval since the beginning of the low power consumption state is shorter than a predetermined standby time.

15. The method of claim 14, further comprising causing the lamp ballast to change from the low power consumption state to the preheat state for a second preheat time that is longer than the first preheat time before entering the lamp operating state, responsive to the detector signal indicating during the low power consumption state that the power supply voltage is present and the lamp is present, and if an interval between a beginning of the low power consumption state and the detection of the power supply voltage is longer than the standby time.

16. The method of claim 15, wherein the second preheat time is at least 60% of the standby time.

17. The method of claim 14, wherein the first preheat time is shorter than the standby time.

18. The method of claim 17, wherein the first preheat time is 20% or less of the standby time.

19. The method of claim 15, wherein the operating parameter is an output current of the lamp ballast.

20. An apparatus, comprising:

a converter having an input, and having an output configured to be connected to a lamp, the converter being configured to be any of a low power consumption state, a preheat state, and a lamp operating state;

a transformer stage having an input configured to receive a power supply voltage and an output coupled to the input of the converter; and a drive circuit configured to:

drive the transformer stage and the converter, to monitor an operating parameter of the apparatus, cause the converter to enter the low power consumption state responsive to the operating parameter, monitor, after causing the converter to enter the low power consumption state, the operating parameter cyclically during a monitoring time, and cause the converter to enter the lamp operating state without a preheat state or to enter the lamp operating state after a preheat state having a first preheat time, responsive to the cyclically monitored operating parameter indicating that a power supply voltage is present and if an interval since the beginning of the state of low power consumption is shorter than a predetermined standby time.

21. The apparatus of claim 20, wherein the drive circuit is configured to cause the lamp ballast to change from the low power consumption state to the lamp operating state after the preheat state having a second preheat time that is longer than the first preheat time, responsive to the detector signal indicating during the low power consumption state that the power supply voltage is present and if an interval between a beginning of the low power consumption state and the detection of the power supply voltage is longer than the standby time.

22. The apparatus of claim 21, wherein the second preheat time is at least 60% of the standby time.

23. The apparatus of claim 20, wherein the first preheat time is shorter than the standby time.

24. The apparatus of claim 20, wherein the first preheat time is 20% or less of the standby time.

25. The apparatus of claim 20, wherein the transformer stage is configured to be in a low power consumption state and an operating state, and the drive circuit is configured to cause the transformer stage to enter the low power consumption state responsive to the operating parameter indicating an outage of the power supply voltage.

26. The apparatus of claim 20, further comprising a power supply coupled to the converter and configured to provide a power supply voltage for the drive circuit.

27. The apparatus of claim 26, wherein the drive circuit is configured to cause the converter to enter a wait state during a monitoring time.

28. The apparatus of claim 27, wherein the converter comprises a half-bridge circuit having two switches and the drive circuit is configured to drive the switches at a first switch frequency during the monitoring time and at a second switch frequency, which is lower than the first switch frequency, during the lamp operating state.

* * * * *